US005575100A

United States Patent [19]

Marvin et al.

[11] Patent Number: 5,575,100

[45] Date of Patent: Nov. 19, 1996

[54] ELECTRONIC SHELF LABEL PROTECTIVE COVER

[75] Inventors: Russel H. Marvin, Riverton, Wyo.; Donald W. Carr, Birmingham, Mich.

[73] Assignee: AT&T Global Information Solutions Company, Dayton, Ohio

[21] Appl. No.: 264,398

[22] Filed: Jun. 23, 1994

[51] Int. Cl.[6] ..... G09F 3/18

[52] U.S. Cl. ..... 40/642; 40/5

[58] Field of Search ..... 40/642, 661, 653, 40/5

[56] References Cited

U.S. PATENT DOCUMENTS

| | | | |
|---|---|---|---|
| 448,290 | 3/1891 | Zallud | 40/5 |
| 1,391,090 | 9/1921 | Anderson | 40/642 |
| 1,615,332 | 1/1927 | King | 40/653 |
| 2,770,898 | 11/1956 | Lutz et al. | 40/5 X |
| 4,545,140 | 10/1985 | Winston | 40/661 |
| 4,723,368 | 2/1988 | Brechbill et al. | 40/642 X |
| 4,746,045 | 5/1988 | Schweim | 40/661 X |
| 5,081,777 | 1/1992 | Kim | 40/653 X |
| 5,121,563 | 6/1992 | Connor et al. | 40/661 |

FOREIGN PATENT DOCUMENTS

| | | | |
|---|---|---|---|
| 0497533 | 8/1992 | European Pat. Off. . | |
| 2125765 | 3/1984 | United Kingdom | 40/642 |
| 2204726 | 11/1988 | United Kingdom | 40/642 |
| 2212965 | 8/1989 | United Kingdom . | |
| 2249854 | 5/1992 | United Kingdom . | |
| 2266401 | 10/1993 | United Kingdom . | |
| WO9212657 | 8/1992 | WIPO . | |

*Primary Examiner*—Joanne Silbermann
*Attorney, Agent, or Firm*—Paul W. Martin

[57] ABSTRACT

An electronic shelf label protective cover whose size is independent of the size of an electronic display module for displaying price information, and whose size is sufficient to contain a display tag containing information other than price. In a first embodiment, the protective cover is made of translucent or transparent plastic and includes a primary cover member having first and second ends, a first resilient side member coupled to the first end for grasping the first side of the electronic display module, a second side member coupled to the second end, a top side member extending from the second side member and coupled to the primary cover member, a bottom side member extending from the second side member and coupled to the primary cover member, a resilient top holder extending downwardly from the top side member and coupled to the primary cover member for grasping the second side of the electronic display module, and a resilient bottom holder extending upwardly from the bottom side member and coupled to the primary cover member for grasping the second side of the electronic display module. A second embodiment is also disclosed having a primary cover member and first and second resilient side members for grasping the first and second sides of the electronic display module.

8 Claims, 4 Drawing Sheets

ELECTRONIC SHELF LABEL PROTECTIVE COVER

BACKGROUND OF THE INVENTION

The present invention relates to electronic shelf label systems and more specifically to a protective cover for electronic shelf labels.

Electronic shelf label systems employ electronic shelf labels for displaying price information for items on the shelves. These systems normally include electronic modules having liquid crystal displays and associated wiring harnesses. The electronic display modules come in standard sizes dictated by the dimensions of the shelves in which they are installed. The harnesses from each of the shelves are connected to a central controller where prices can be conveniently changed at one location. Electronic shelf label systems allow prices to be changed much more quickly than conventional printed and gummed labels.

Unfortunately, electronic display modules cannot display information in addition to price without being cost-prohibitive. To convey information such as item name, item size, and item bar code label, paper display tags are normally employed on the face of the electronic display module. These paper display tags are price-sensitive and are produced in various standard sizes. Display tags offer the advantage that they do not have to be changed unless the location of the item changes. Some tags are small enough to allow a large number of different items to be located on the same shelf.

Unfortunately, electronic shelf labels are subjected to routine wear. Display tags made of paper are especially susceptible to wear and must eventually be replaced. It would be difficult and costly to produce a protective cover for every size of electronic shelf label. Therefore, it would be desirable to provide a low-cost protective cover for standard sizes of electronic shelf labels. The covers should be easily removable and replaceable to facilitate removal and replacement of display tags and electronic display modules.

SUMMARY OF THE INVENTION

In accordance with the teachings of the present invention, an electronic shelf label protective cover is provided. The protective cover is part of a system including an electronic display module for displaying price information having first and second sides and a front side, and a display tag between the electronic display module and the protective cover for displaying information other than price, without obscuring the price information, and having a size independent of the size of the front side of the electronic display module.

The protective cover is made of transparent plastic and includes a primary cover member having first and second ends, a resilient first side member coupled to the first end of the primary cover member for grasping the first side of the electronic display module, a second side member coupled to the second end of the primary cover member, a top side member extending from the second resilient side member and coupled to the primary cover member, a bottom side member extending from the second resilient side member and coupled to the primary cover member, a resilient top holder extending downwardly from the top side member and coupled to the primary cover member for grasping the second side of the electronic display module and for retaining the display tag in place, and a resilient bottom holder extending upwardly from the bottom side member and coupled to the primary cover member for grasping the second side of the electronic display module and for retaining the display tag in place.

It is a feature of the present invention that the size of the display tag is sufficient to display the information other than price.

It is another feature of the present invention that the size of the protective cover is sufficient to contain the display tag.

It is accordingly an object of the present invention to provide an electronic shelf label protective cover.

It is another object of the present invention to provide an electronic shelf label protective cover whose size is independent of the size of the electronic display module.

It is another object of the present invention to provide an electronic shelf label protective cover for standard label sizes.

It is another object of the present invention to provide an electronic shelf label protective cover, which is easily removable and replaceable.

It is another object of the present invention to provide an electronic shelf label protective cover, which is low in cost.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
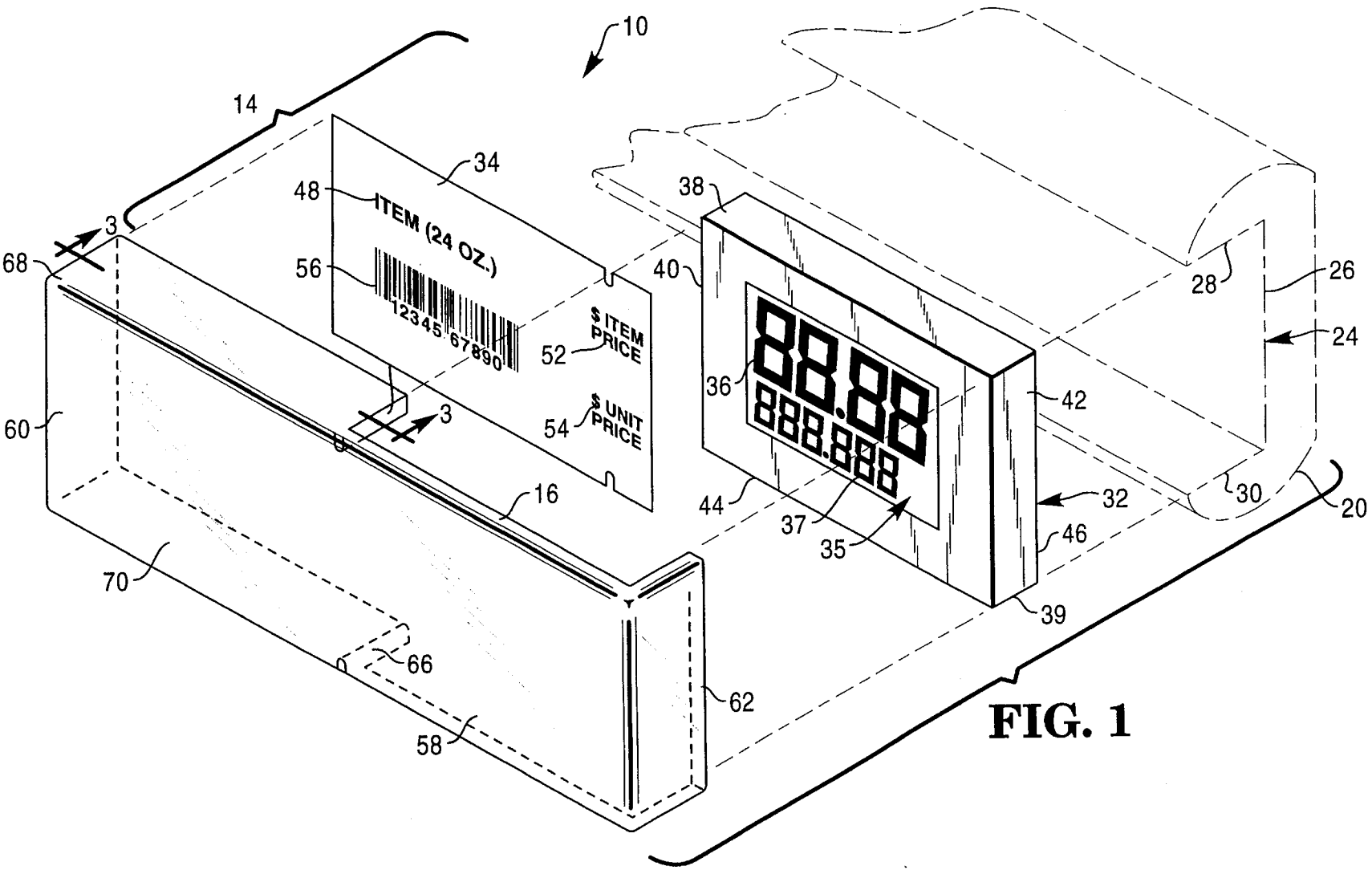
FIG. 1 is an exploded view of an electronic shelf label system employing a first embodiment of the protective cover of the present invention.
Figure 2:
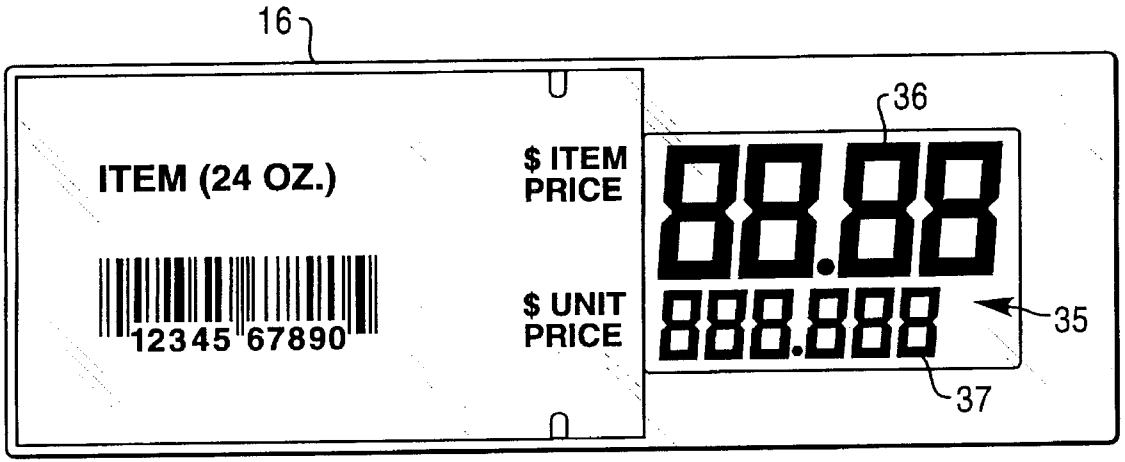
FIG. 2 is a front view of the electronic shelf label system of FIG. 1 when fully assembled.
Figure 3:
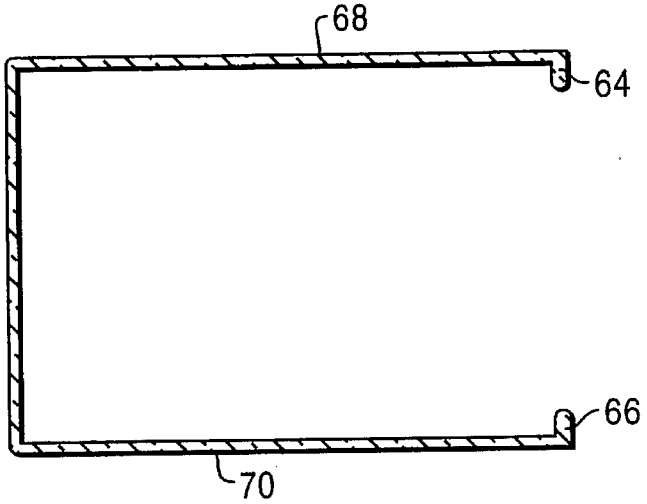
FIG. 3 is a sectional view of the protective cover of FIGS. 2 and 3, taken along line 3—3 of FIG. 1.

Turning now to FIGS. 1, 2, and 3, electronic shelf label system 10 includes electronic shelf label 14, and protective cover 16. Electronic shelf label system 10 is mounted within rail member 20. Rail member 20 is mounted to the leading edge of a shelf, typically using hooks. Rail member 20 includes channel 24, which is defined by vertical wall 26, upper wall 28, and lower wall 30.

Electronic shelf label 14 includes electronic display module 32 and display tag 34. Electronic display module 32 can be any commercially available unit that provides price information. In the preferred embodiment, an electronic display module 32 which employs a liquid crystal display 35 is used. This electronic display module 32 is capable of displaying two prices, such as regular price 36 and sale or unit price 37. It is is box-like in shape and conforms to the shape of channel 24. It includes top side 38, bottom side 39, left side 40, right side 42, front side 44, and back side 46.

Display tag 34 provides printed information such as item name 48 and size, and legends for item and unit prices 52 and 54. A Uniform Product Code (UPC) or bar code label 56 is normally included as well. Here, display tag 34 is made of paper and is about the same size as front side 44 of electronic display module 32 and is side-mounted, thus providing more space for displaying information than display tags mounted solely on front side 44 of electronic display module 32.

The present invention envisions producing standard sizes of covers which may be the same size or larger than the front sides of available electronic display modules. In this embodiment, protective cover 16 is made of translucent plastic or clear transparent plastic and includes primary cover member 58 which is larger in size than front side 44 and which is rectangular in shape. Protective cover 16 includes left and right side members 60 and 62. In this embodiment only right side member 62 is resilient and biased inwards for grasping right side 42 of electronics display module 32 when protective cover 16 is installed over front side 44 of electronic display module 32. Protective cover 16 employs top and bottom holders 64 and 66 (FIG. 3). Top holder 64 extends downwardly from top side member 68 and joins primary cover member 58. Bottom holder 66 extends upwardly from bottom side member 70 and joins primary cover member 58. Top and bottom holders 64 and 66 grasp left side 40 of electronic display module 32. Advantageously, the use of the two holders 64 and 66 allows display tag 34 to be retained against the inner surface of primary cover member 58 by front side 44 of electronic display module 32. The resiliency of right side member 62 and top and bottom holders 64 and 66 makes protective cover 16 easily removable and replaceable for repairing electronic shelf label 14.

Advantageously, producing standard sizes of protective covers allows the cover size to dictate the sizes of the paper display tags instead of the sizes of the electronic modules. Thus, the paper display tags can be customized to satisfy individual needs. An additional advantage is that only a single size electronic module need be used for all shelf items.

Figure 4:
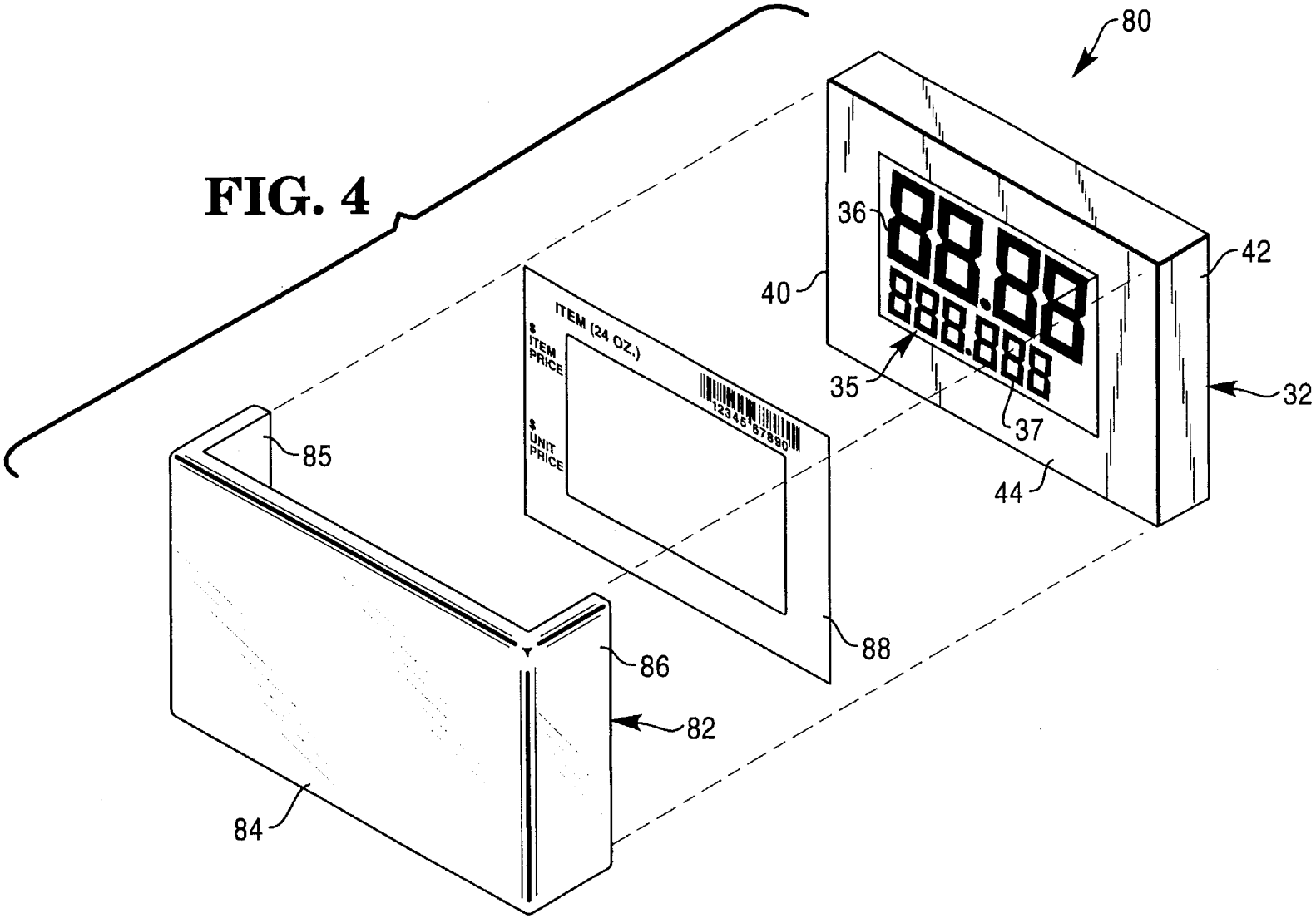
FIG. 4 is an exploded view of a second electronic shelf label system employing a second embodiment of the protective cover of the present invention.
Figure 5:
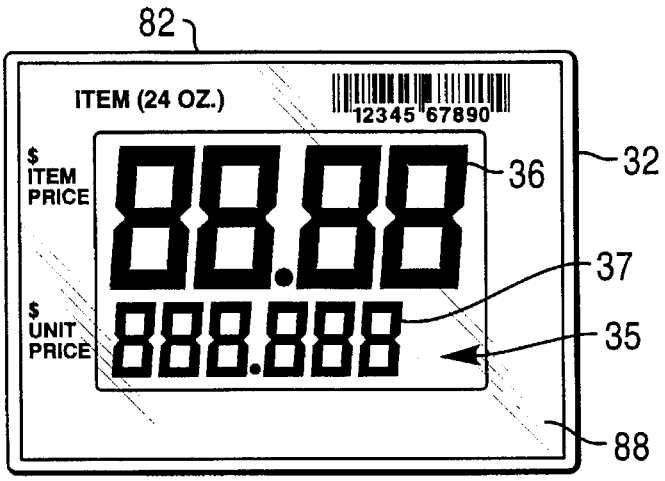
FIG. 5 is a front view of the electronic shelf label system of FIG. 4 when fully assembled.

Turning now to FIGS. 4 and 5, a second shelf labeling system 80 is shown in which protective cover 82 is the same size as electronic display module 32 in order to maximize the number of shelf items per shelf. Protective cover 82 includes primary cover member 84, having the same size as front side 44 of electronic display module 32, and left and right side members 85 and 86. Left and right side members 85 and 86 are resilient and biased inwardly so as to firmly grasp left and right sides 40 and 42 of electronic display module 32. Left and right resilient side members 85 and 86 make protective cover 82 easily removable and replaceable.

Display tag 88 is made of paper and is placed against front side 44 of electronic display module 32 around its perimeter without obscuring regular price 36 and sale or unit price 37. Display tag 88 is sandwiched between primary cover member 84 and electronic display module 32 to hold it in place.

Figure 6:
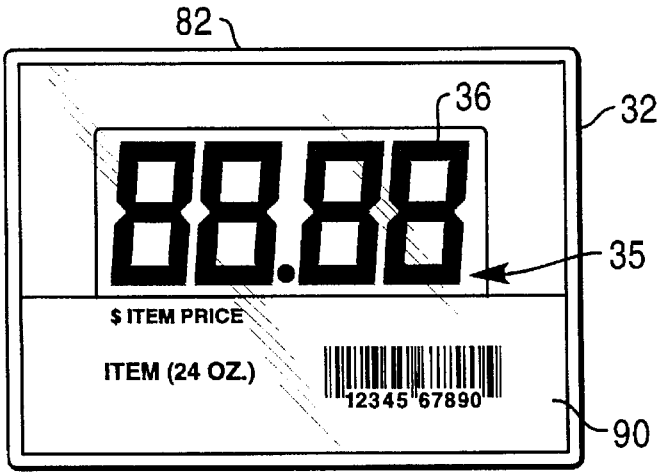
FIG. 6 is a front view of a third electronic shelf label system employing the second embodiment the present invention.

Referring now to FIG. 6, protective cover 82 of FIGS. 4 and 5 is used to protect a third type of display tag 90. Here, electronic display module 32 does not display sale or unit price 37 in order to provide extra space for the larger display tag 90. Display tag 90 is rectangular in shape and sits on front side 44 of electronic display module 32 below regular price 36.

Figure 7:
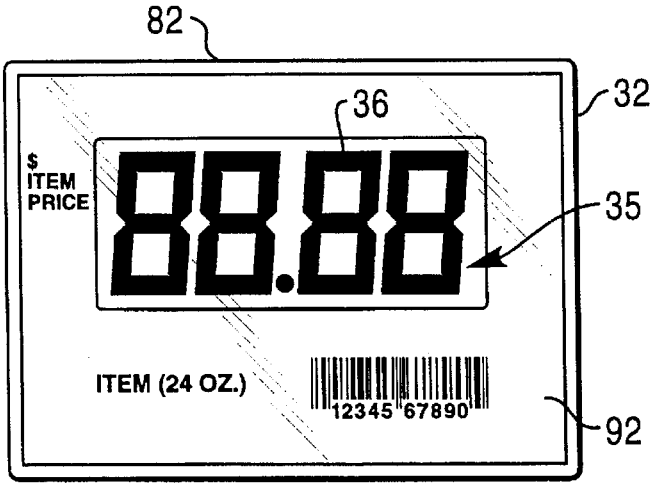
FIG. 7 is a front view of a fourth electronic shelf label system employing the second embodiment of the present invention.

Turning now to FIG. 7, protective cover 82 of FIGS. 4 and 5 is used to protect a fourth type of display tag 92. Like electronic display module 32 of FIG. 5, electronic display module 32 of FIG. 7 only provides regular price 36. Display tag 92 is of the perimeter type, but is larger in size due to the smaller display 35.

Although the invention has been described with particular reference to certain preferred embodiments thereof, variations and modifications of the present invention can be effected within the spirit and scope of the following claims.

What is claimed is:

1. An electronic shelf label system comprising:

an electronic display module for displaying price information having first and second sides and a front side;

a transparent protective cover having a size independent of the size of the front side of the electronic display module, and including a primary cover member having first and second ends, a resilient first side member coupled to the first end of the primary cover member for grasping the first side of the electronic display module, a second side member coupled to the second end of the primary cover member, a top side member extending from the second side member and coupled to the primary cover member, a bottom side member extending from the second side member and coupled to the primary cover member, a resilient top holder extending downwardly from the top side member and coupled to the primary cover member for grasping the second side of the electronic display module, and a resilient bottom holder extending upwardly from the bottom side member and coupled to the primary cover member for grasping the second side of the electronic display module; and a display tag, held in place between the protective cover and the electronic display module by the top and bottom holders, for displaying information other than price, without obscuring the price, having a size independent of the size of the front side of the electronic display module, wherein the size of the display tag is sufficient to display the information other than price, and wherein the size of the protective cover is sufficient to contain the display tag.

2. An electronic shelf label system comprising:

an electronic display module for displaying price information having first and second sides and a front side;

a protective cover having a size independent of the size of the front side of the electronic display module including a primary cover member having first and second ends, a resilient first side member coupled to the first end of the primary cover member for grasping the first side of the electronic display module, a second side member coupled to the second end of the primary cover member, a top side member extending from the second side member and coupled to the primary cover member, a bottom side member extending from the second side member and coupled to the primary cover member, a resilient top holder extending downwardly from the top side member and coupled to the primary cover member for grasping the second side of the electronic display module, and a resilient bottom holder extending upwardly from the bottom side member and coupled to the primary cover member for grasping the second side of the electronic display module; and a display tag between the electronic display module and the protective cover, having a size independent of the size of the front side of the electronic display module, for displaying information other than price without obscuring the price information.

3. The system as recited in claim 2, wherein the protective cover is made of transparent plastic.

4. The system as recited in claim 2, wherein the protective cover is made of translucent plastic.

5. The system as recited in claim 2, wherein the size of the display tag is sufficient to display the information other than price.

6. The system as recited in claim 2, wherein the size of the protective cover is sufficient to contain the display tag.

7. The system as recited in claim 2, wherein the display tag and protective cover are produced in a plurality of sizes of electronic price display modules.

8. The system as recited in claim 2, wherein the display tag is made of paper.

* * * * *